United States Patent [19]

Wordell, Sr.

[11] 4,008,677

[45] Feb. 22, 1977

[54] RETRACTIBLE RUDDER

[76] Inventor: David Hazard Wordell, Sr., R.F.D. 1 (Salem), Oakdale, Conn. 06370

[22] Filed: Oct. 2, 1975

[21] Appl. No.: 618,750

[52] U.S. Cl. ..... 114/162; 114/165

[51] Int. Cl.[2] ..... B63H 25/06

[58] Field of Search ..... 114/165, 132, 131, 130, 114/162; 115/41 R

[56] References Cited

UNITED STATES PATENTS

| | | | |
|---|---|---|---|
| 3,352,272 | 11/1967 | Brazier | 114/165 |
| 3,575,124 | 4/1971 | Alter | 114/165 |
| 3,752,105 | 8/1973 | Hackett | 114/162 |
| 3,752,111 | 8/1973 | Meynier | 115/41 R |
| 3,921,561 | 11/1975 | Arce | 114/165 |
| 3,952,682 | 4/1976 | Ingham | 114/162 |

*Primary Examiner*—Trygve M. Blix
*Assistant Examiner*—Gregory W. O'Connor

[57] ABSTRACT

A transom mounted retractible rudder for sailboats or other small vessels. A rudder blade is pivotally mounted on a lower portion of a rudder stock. By means of a handle located adjacent the stern of the boat and connected through a linkage to the rudder blade, a crew member can raise and lower the rudder blade between a fully retracted position and a fully extended position. The handle and a dial on the rudder stock cooperate to provide an indication of the attitude and depth of the rudder blade at any given time.

10 Claims, 4 Drawing Figures

RETRACTIBLE RUDDER

BACKGROUND OF THE INVENTION

This invention relates generally to vessels which regularly operate in both shallow and deep water and, more particularly, to an apparatus for selectively altering the depth of such a vessel's rudder.

It has been a common expedient to provide small vessels, and particularly small sailboats, with retractible rudders which permit the vessel to sail into shallow waters or to even be beached without causing harm to the rudder itself. Such devices have also often provided for retraction of the rudder in the event it should strike a submerged object.

In some of these constructions which have been in use prior to the present time, the rudder blade could only assume two positions, namely, a fully extended position or a fully retracted position. In any intermediate position the rudder blade would merely hang loosely and uncontrolled until such time that it should move or be moved to either of the extreme positions. At these extreme positions, it was customary for the rudder blade to be held against further movement by means of a detent mechanism or by some other device.

In some other known constructions in which the rudder blade was actually able to assume one or more firmly held intermediate positions, these intermediate positions were usually of a minimal number. Such constructions therefore, could not accommodate the broad range of positions which might be desirable under greatly varying conditions. Furthermore, in those instances in which an infinite range of positions between a fully extended and a fully retracted position was possible, the construction was usually applied to large ships utilizing rudders fabricated of dense materials such as copper, steel, and the like. Ropes or chains or other non-rigid connections between the rudder blade and the deck of the ship were utilized for raising and lowering of the rudder blade. In these instances, the weight of the rudder was relied upon for maintaining the ropes or chains taut. However such constructions are not applicable to the rudder assembly presently being considered. Specifically, the present invention is concerned with the rudder blade for a relatively small vessel which would likely be composed of a material such as wood or fiberglass having a density normally lighter than water. As such, a rudder blade would be unable to submerge itself under its own weight or in the absence of a rigid connection between it and the vessel.

Additionally, the known art includes a number of instances in which the tiller is employed for adjusting the depth of the rudder blade. Although there may be a benefit by combining the normal operation of the tiller with the operation of raising and lowering the rudder blade under normal conditions, this is undesirable and can be quite hazardous under adverse conditions. Under such conditions each of the operations should be performed separately and by means of separate devices to assure independence of operation and without compromising the performance characteristics of each device.

SUMMARY OF THE INVENTION

The present invention offers a substantial improvement over these prior constructions. As disclosed, the invention is utilized in combination with a rudder stock secured against vertical movement and mounted for yaw movement adjacent to the stern of a boat. A rudder blade is pivotally mounted on the rudder stock for movement about an axis transverse to the plane of the rudder stock between an extended and a retracted position. A hand operated crank rotatably mounted on the rudder stock is connected to the rudder blade by means of a rigid linkage for raising and lowering the rudder blade as desired. As used in this context, the term "rigid" is taken to mean that the hand crank is continuously connected to the rudder blade and that the distance between the pivot for the crank and the axis about which the rudder blade pivots always remains the same and, additionally, that the linkage connecting the crank and the rudder blade always remains the same length. The pivot mounting the rudder blade onto the rudder stock can be selectively tightened to permit movement of the blade upon movement of the crank while simultaneously enabling the rudder blade to maintain any desired intermediate position.

With the construction disclosed, although the rudder blade is manually movable and can even by maintained in any desired intermediate position, should the rudder blade strike a submerged object, it remains substantially free to rotate to its retracted position so that damage to the rudder blade and transom can be avoided or minimized.

The crank is provided with an integral foot member which has a longitudinal axis substantially parallel to the trailing edge of the rudder blade. Thus, a glance at the crank from the cockpit of the vessel can inform the viewer of the similar attitude of the rudder blade. As a further aid, a dial or other indicating device can be mounted on the rudder stock to indicate the depth of the rudder blade at any given position of the crank.

Additionally, mechanical stops are provided to define the limits of the movement for the rudder blade at the fully retracted and at the fully extended positions.

Thus, the present invention avoids the drawbacks of the currently known devices as recited above. Furthermore, it is of a simplified construction which permits remote positioning of the depth of the rudder blade and at the same time provides an indication of the angle and depth of the rudder blade. Because the invention is operated independently of the tiller, the ability to steer the vessel is not compromised under adverse operating conditions. Of particular importance is the design of the invention which enables a wide range of vessels currently in use to be easily modified to utilize the benefits of the invention.

It is to be understood that both the foregoing general description and the following detailed description are exemplary and explanatory but are not restrictive of the invention.

The accompanying drawings which are incorporated in, and constitute a part of this invention, illustrate a preferred embodiment of the invention, and together with the description, serve to explain the principles of the invention.

OF THE DRAWINGS

DETAILED DESCRIPTION OF THE INVENTION

Figure 1:
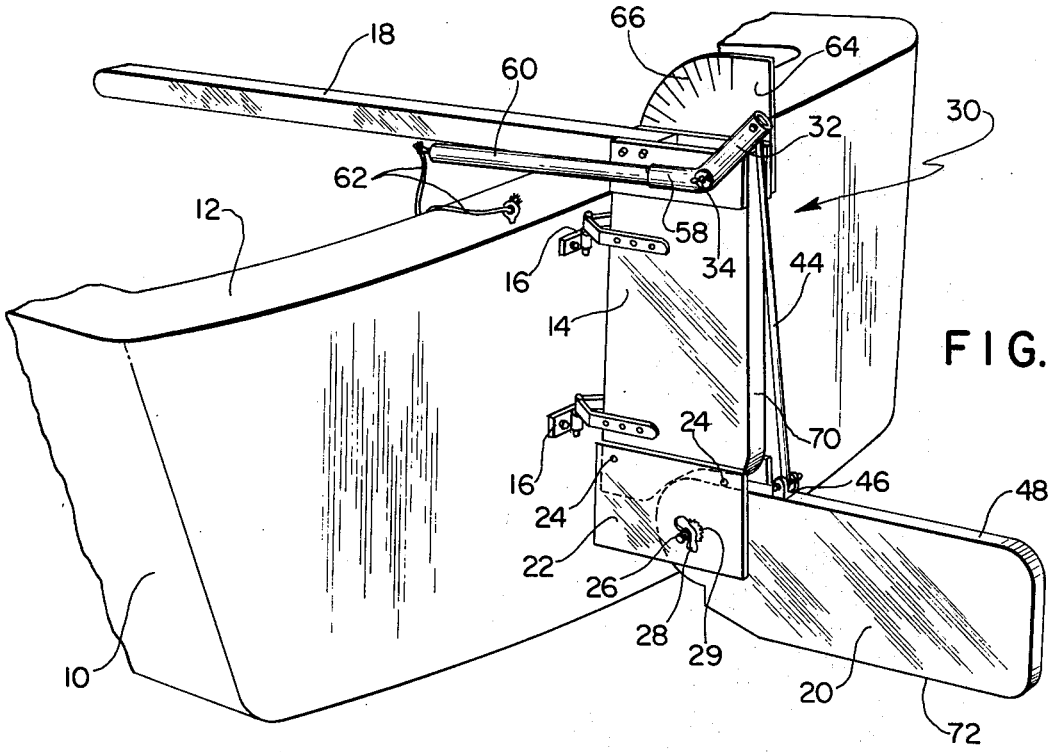
FIG. 1 is a perspective view of a typical vessel employing the invention.

Referring now to the drawings, and initially to FIG. 1, a vessel 10, which may be a sailboat, is illustrated as having a transom 12 at its stern. A rudder stock 14 is supported on the transom 12 by means of hinges 16 for yaw movement relative to a longitudinal axis of the vessel 10. Such movement may be imparted to the rudder stock 14 in a conventional manner by means of a tiller 18.

In accordance with the invention, a rudder blade 20 is pivotally mounted on the lower portion of the rudder stock 14. For this purpose, a pair of plates 22 are suitably fastened by means of bolts 24 or the like to the bottom of the rudder stock to form a pair of cheeks for receiving one end of the rudder blade 20 between them. A bolt 26 or other suitable fastener extends through a suitable bore in the plates and a similarly positioned bore through the rudder blade 20, and a wing nut 28 is utilized to secure the rudder blade 20 on the plates 22. A lock washer 29 may be utilized in cooperation with the wing nut 28 to prevent the wing nut from vibrating loose. The wing nut 28 is preferably tightened to an extent which permits the rudder blade 20 to be moved manually relative to the rudder stock 14 and to maintain the position to which it has been moved. Thus, as here embodied, the bolt 26 serves as pivot means mounting the rudder blade 20 for movement about an axis transverse to the plane of the rudder stock 14 for movement between a retracted position as indicated by solid lines and an extended position as indicated by dotted lines.

In accordance with the invention, an operative mechanism generally indicated at 30 is mounted on the rudder stock 14 rigidly connected to the rudder blade 20 for moving the rudder blade 20 between the extended and retracted positions. As here embodied, the operative mechanism 30 includes a crank 32 which is rotatably mounted on the rudder stock 14 by means of a pin 34. A portion of the pin 34 is threaded so as to receive the lock nuts 36 and 38 which fix the pin 34 on the rudder stock 14. The crank 32 is journaled on an unthreaded length of the pin 34 and is held in place by means of a washer 40 and cotter pin 42 suitably attached at the outer end of the pin 34. Thus, the crank 32 is free to rotate relative to the rudder stock 14.

Also an element of the operative mechanism 30 is a rod 44 which extends between the crank 32 and the rudder blade 20. The lower end of the rod 44 is suitably rotatably connected to clevis 46 which, in turn, is fastened to the rudder blade 20 adjacent its trailing edge 48. The upper end of the rod 44 is provided with a collar 50 being integral therewith in any suitable fashion such as by welding or the like. The collar 50 is slideably received on a crank pin 52 which is fixed to an end of the crank 32 and on which is received a sleeve 54 between the crank 32 and the collar 50. A cotter pin 56 suitably applied to the free end of the crank pin 52 holds the collar 50 and the sleeve 54 in position on the crank pin 52. Thus it will be appreciated that rotation of the crank 32 will result in a proportionate rotation of the rudder blade 20.

Figure 2:
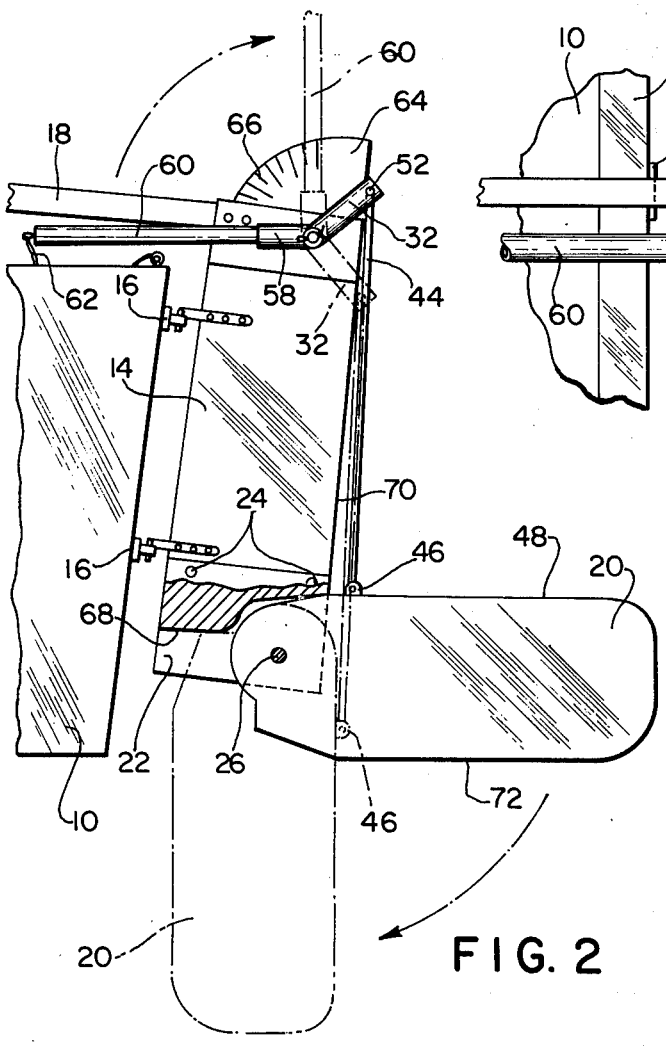
FIG. 2 is a side elevation view of the stern of the vessel utilizing the invention and of the invention itself.
Figure 3:
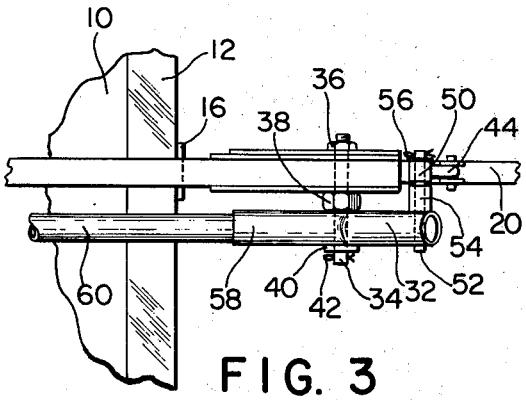
FIG. 3 is a top plan view of elements illustrated in FIG. 2.
Figure 4:
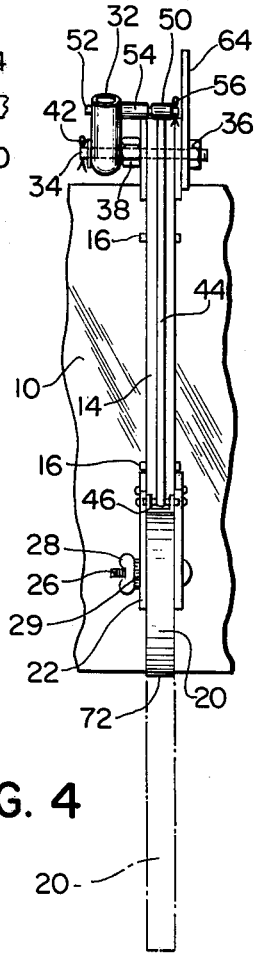
FIG. 4 is a rear elevation view of the invention illustrated in FIG. 2.

As is seen particularly in FIG. 2, the crank 32 includes an integral foot member 58 having a longitudinal axis which is substantially parallel to the trailing edge 48 of the rudder blade 20. As illustrated, the trailing edge 48 is representative of a longitudinal axis of the rudder blade 20. Thus, the foot member 58 is effectively parallel with a primary axis of the rudder blade 20. Additionally, the foot member 58 is hollow and open at its end so as to receive one end of a removable arm or handle 60. The handle 60 may be held within the foot member 58 by means of a detent mechanism (not shown) or by friction or in some other desired fashion. In any event, the handle 60 provides additional leverage for the ease of a crew member in operating the operative mechanism 30. To prevent loss of the handle 60 overboard in the event it should become freed from the foot member 58, it may be desirable to provide a tether 62 attached to the free end of the handle 60 and to the transom 12.

As has already been described, there is a direct relationship between the axis of the foot member 58 and the trailing edge 48 of the rudder blade 20. This being the case, an indicator 64 (FIGS 1 and 2) may be provided integral with the rudder stock 14 with suitable graduations 66 calibrated to indicate the depth of the rudder blade 20 at any given position of the foot member 58.

It has been previously described that movement of the crank 32 by means of the foot member 58 and handle 60 serves to move the rudder blade 20 from a fully retracted position through intermediate positions to a fully extended position. In accordance with the invention, a first stop means defines the retracted position of the rudder blade 20 as indicated by solid lines in FIG. 2. As here embodied, the lower portion of the rudder stock 14 terminates at an edge 68 located between the plates 22. When the rudder blade 20 is in its fully retracted position, its trailing edge 48 engages the edge 68 of the rudder stock and prevents further upward movement of the rudder blade 20. In a similar manner, when the rudder blade 20 assumes the fully extended position indicated by the dotted lines in FIG. 2, the collar 50 and the sleeve 54 on the crank pin 52 engage a trailing edge 70 of the rudder stock 14 and prevent any further downward movement of the rudder blade 20.

In operation, then, it is seen that by manually moving the handle 60 between the solid line position and the dotted line position (FIG. 2), the rudder blade 20 is similarly moved from the retracted or solid line position to the extended or dotted line position. It is preferable to tighten the wing nut 28 to an extent that permits movement of the rudder blade 20 under urging of the handle 60 but maintains any selected position of the rudder blade 20 when motion is no longer imparted to the handle 60. As the handle 60 is rotated, intermediate positions of the rudder blade 20 can be readily visualized. In addition, the depth of the rudder blade 20 can be ascertained by means of the indicator 64.

At the same time, should a leading edge 72 of the rudder blade 20 strike an underwater object, the rudder blade 20 is free to pivot upwardly toward its retracted position so as to prevent or minimize any damage from occurring.

A notable feature of the invention resides in the fact that it can be readily applied to existing vessels. Specifically, it would only be necessary to mount the clevis 46 to an existing rudder blade and to mount the crank 32 onto an existing rudder stock by means of the pin 34. Thus, the present invention can be a retrofit assembly as well as being applicable to new vessels.

When not in use, the handle 60 can be removed from the foot member 58 and suitably mounted on the transom 12 so as to be readily available for use. As an alternative, the handle 60 could be retained mounted in the foot member 58 and used as a flagstaff for one or more small pennants which are often flown from the stern of pleasure vessels.

The invention, in its broader aspects is not limited to the specific details shown and described, and departures may be made from such details without departing from the principles of the invention, and without sacrificing its chief advantages.

What is claimed is:

1. In combination with a rudder stock secured against vertical movement and mounted for yaw movement adjacent the stern of a vessel, the improvement comprising:

a rudder blade pivotally mounted on a lower portion of said rudder stock;

pivot means mounting said rudder blade for movement about an axis transverse to the plane of said rudder stock for movement between a retracted and an extended position;

operative means mounted on said rudder stock and rigidly connected to said rudder blade for moving said rudder blade between said retracted and extended positions;

first stop means defining said retracted position and second stop means defining said extended position; and fastening means associated with said pivot means for releasably fixing said rudder blade in any one of an infinite number of positions intermediate said retracted and extended positions.

2. The combination as set forth in claim 1 including indicating means remote from said rudder blade for continuously indicating all positions assumed thereby between and including said retracted and extended positions.

3. The combination as set forth in claim 1 wherein said operative means includes a crank pivotally mounted on said rudder stock; and a rod extending between said crank and said rudder blade and pivotally mounted, respectively, to said crank and said rudder blade whereby rotation of said crank between a first and a second position results in movement of said rudder blade between said retracted and extended positions.

4. The combination as set forth in claim 3 wherein said crank includes an integral foot member having a longitudinal axis substantially parallel to a primary axis of said rudder blade whereby said foot member indicates all positions assumed by said rudder blade between said retracted and extended positions.

5. The combination as set forth in claim 4 including a handle removably attached with said foot member for rotation of said crank and resulting movement of said rudder blade between said retracted and extended positions.

6. The combination as set forth in claim 3 wherein said crank includes an integral foot member having a longitudinal axis substantially parallel to a primary axis of said rudder blade and including a calibrated dial fixed to said rudder stock, said foot member responsive to the position of said rudder blade for indicating on said dial the position and the depth of said rudder blade.

7. The combination as set forth in claim 1 wherein said rudder stock has a trailing edge and wherein said operative means includes a crank pivotally mounted on said rudder stock; a rod extending between said crank and said rudder blade and positioned aft of said rudder stock but lying substantially in the plane thereof; a crank pin having an axis transverse of the plane of said rudder stock fixed to said crank and pivotally connected to one end of said rod, the other end of said rod being pivotally connected to said rudder blade adjacent the trailing edge thereof; the relationship between said trailing edge of said rudder blade and said rudder stock being such that when said rudder blade is in said retracted position, the trailing edge of said rudder blade engages said rudder stock preventing further movement of said rudder blade; and the relationship between said crank pin and said rudder blade being such that when said rudder blade is in said extended position, said crank pin engages the trailing edge of said rudder stock preventing further movement of said rudder blade.

8. The combination as set forth in claim 7 wherein said crank includes an integral foot member having a longitudinal axis substantially parallel to the trailing edge of said rudder blade and including a calibrated dial fixed to said rudder stock, said foot member responsive to the position of said rudder blade for indicating on said dial the position and the depth of said rudder blade.

9. The combination as set forth in claim 8 including a handle removably attached with said foot member for rotation of said crank and resulting movement of said rudder blade between said retracted and extended positions.

10. The combination as set forth in claim 7 including fastening means associated with said pivot means for releasably fixing said rudder blade in selected positions intermediate said retracted and extended positions.

* * * * *